United States Patent [19]

Lovinger et al.

[11] Patent Number: 4,905,878

[45] Date of Patent: Mar. 6, 1990

[54] BELT BUCKLE HAVING MEANS FOR CONCEALING AND SECURELY RETAINING KEYS OF DIFFERENT SIZES

[76] Inventors: William Lovinger, 6009 21st Ave., Brooklyn, N.Y. 11204; Harry Sielmann, 3319 Kings Hwy., Brooklyn, N.Y. 11234

[21] Appl. No.: 330,295

[22] Filed: Mar. 29, 1989

[51] Int. Cl.[4] ..... A44B 11/00

[52] U.S. Cl. ..... 224/163; 224/195; 224/224; 224/229; 24/3 K; 24/163 K; 70/456 R

[58] Field of Search ..... 224/163, 195, 224, 225, 224/229, 249; 2/300, 311, 312; 24/3 R, 3 F, 31 R, 3 K, 163 K; 70/456 R

[56] References Cited

U.S. PATENT DOCUMENTS

| | | | |
|---|---|---|---|
| 1,599,920 | 9/1926 | Pryor | 224/163 |
| 2,339,297 | 1/1944 | Segal | 224/163 |
| 2,358,351 | 9/1944 | Segal | 229/163 |
| 2,413,337 | 12/1946 | Segal | 224/163 |
| 2,597,170 | 5/1952 | Oldal | 224/163 |
| 3,272,410 | 9/1966 | Reisman | 224/163 |
| 4,125,920 | 11/1978 | Grimes | 70/456 R |
| 4,203,167 | 5/1980 | Collins | 224/229 X |
| 4,521,939 | 6/1985 | Chabot et al. | 224/163 X |

*Primary Examiner*—Ernest G. Cusick
*Attorney, Agent, or Firm*—Philip Young

[57] ABSTRACT

A U-shaped belt buckle is pivotally connected to a buckle tongue and key retainer which includes an elongated tongue body terminating at one end in a tongue tip, the other end of the tongue body forming a part of the key retainer. The key retainer includes an elongated hollow housing being open at opposite ends to form a sleeve through which a key may extend in the direction of the tongue tip. Shoulder wall portions at the key receiving end of the hollow housing serve to abut with the head of the key for positioning the key in the housing. The belt has an opening adapted to receive the elongated tongue body and hollow housing, with belt fastener snap buttons positioned on the belt to also function to retain the key by abutting with the head of the key. When the key is needed, the wearer simply opens the snap buttons and removes the key from the key retainer.

17 Claims, 2 Drawing Sheets

BELT BUCKLE HAVING MEANS FOR CONCEALING AND SECURELY RETAINING KEYS OF DIFFERENT SIZES

FIELD OF THE INVENTION

The present invention relates to key holding and retaining devices, and more particularly to belt buckles employed for holding keys, such as of the household pass key and automobile key types.

BACKGROUND OF THE PRIOR ART

Belt buckles are known having a belt buckle designed with various types of key retaining means wherein one or more keys, such as household latch keys and automobile keys, is contained in the belt buckle and carried by the user for possible use as a spare key.

Generally, the known belt buckle key retainers are complex, requiring one or more specially designed interacting parts which may require difficult manipulation or special hardware, such as a screwdriver, to operate and insert or remove the key. Some of these known key retainers are bulky and require large buckle front plates in order to conceal the key and the key retaining parts. In some retainers, the key is loosely held and may rattle against the plate of the buckle wherein it is being stored. Also, some known key retainers are limited to being able to hold only one sized key having a length, width and thickness that fits the retaining parts. In this connection, there is known a key retainer that requires a specially made key adapted to fit into the buckle retainer. Still, there is known a belt buckle that employs the key as the belt tongue so that only that specifically sized key can be used with the buckle and belt combination More specifically, one known latch key holding device is described in U.S. Pat. No. 1,599,920 issued on Sept. 14, 1926 to John A. Pryor and includes a key holding attachment located behind a front face plate of a buckle, flush with a back plate, and supported to extend vertically therein. The key holding attachment receives a specially designed key which has a transverse hinge connecting the key body with a key finger piece so that the finger piece folds down flat over the key body and is hidden behind the front face plate. This belt buckle and key holding attachment is limited to use with specially designed keys having a foldable end finger piece so that the key stays hidden and does not extend vertically up from behind the front face plate. Also, such belt buckle requires a large buckle face plate which may be bulky and cumbersome, in order to conceal the special key, the key holding attachment and associated parts.

In U.S. Pat. No. 2,597,170 issued to F. Oldal on May 20, 1952, there is disclosed a key retaining belt buckle wherein keys are held behind a large buckle plate by a removably mounted plate insert having locating pins and designed to press against and hold two keys in position. Additionally, a cushion is required to prevent rattling of the keys in the buckle. This belt buckle is disadvantageous in that it requires a bulky, large belt buckle plate to conceal the keys, and further requires a separate plate insert and cushion to hold the keys in position and prevent movement and rattling of the keys. In many instances, it is desirable to avoid the use of large buckle plates, both from the standpoint of uncomfortable handling and wearing, as well as poor appearance and eye appeal to some wearers.

In U.S. Pat. No. 3,272,410 to E. Reisman, issued on Sept. 13, 1989, there is disclosed a key belt having a key which is secured to a mounting plate on a buckle by means of a screw or bolt extending through a hole in the key head. The key must be unscrewed or unbolted from the mounting plate in order to remove such key for use. Also, the key is exposed and may not be desirable to some users to wear a key exposed on the belt.

U.S. Pat. No. 4,521,939 to Chabot et al discloses a belt buckle wherein the key constitutes the tongue and is secured to a T-shaped member by a pair of screws. The T-shaped member is pivotally engaged on a central pin by means of a bore within the leg of such member, so that the key acts as the belt tongue. This belt buckle design is impractical in that it requires the tightening and loosening of two screws in order to remove or insert the key. Also, only one size of key will work as the tongue since a shorter key will not reach the cross piece of the buckle and a thicker key body may not fit through the openings in the leather belt. In this connection, some automobile keys may not fit into the retaining section of the T-shaped member and, therefore, can not be secured to the buckle. Also, some keys, such as automobile keys, are substantially different in size from the house keys and would not operate as the tongue member.

Therefore, it is an object of the present invention to provide a belt buckle having means for both concealing and securely retaining keys of different sizes. It is another object to provide a belt buckle for retaining a key in a simple manner, without requiring the manipulation of screws or nuts in order to secure or remove the key from the belt buckle. It is another object of the present invention to provide a belt buckle which conceals and retains keys without requiring a large buckle plate. It is another object to provide a belt buckle which securely retains a hidden key, which can be of different sizes, while preventing the key from shifting within the buckle.

SUMMARY OF THE INVENTION

In view of the above, the present invention provides a belt buckle having means for retaining keys of different sizes, including a U-shaped buckle that is pivotally connected to a tongue and key retainer. The tongue and key retainer includes a longitudinal tongue body, the end of which has a tongue tip, and the tongue body forming a part of the key retainer. The key retainer includes an elongated key body retainer through which the body of the key extends longitudinally, and a key head retainer portion having a wide opening for receiving the wider head of the key. The belt has an opening adapted to receive the longitudinal tongue body therethrough, with belt fastener snap buttons located at a position on the belt such that the snap buttons also function to retain the key so that the head of the key will abut with the snap buttons. The elongated key body retainer is long and narrow in shape so as to present a streamlined appearance of the buckle, while still serving to conceal the key. When using the belt buckle and belt, the key is securely retained in the key retainer and will not rattle or come apart from the belt buckle. When the key is needed, the wearer of the belt buckle simply opens the snap buttons and removes the key from the key retainer.

The key retainer is designed to accommodate different sized keys while still retaining the key in a secure manner. The combination of the key retainer design together with the positioning of the belt snap buttons provides a simple means for retaining keys having different sizes and shapes, while eliminating the need for screws and bolts as well as large buckle housings previously known and which have limited the use of such known belt buckles to one particular key and often involved a relatively complex buckle and key retainer.

DESCRIPTION OF THE PREFERRED EMBODIMENT

Figure 1:
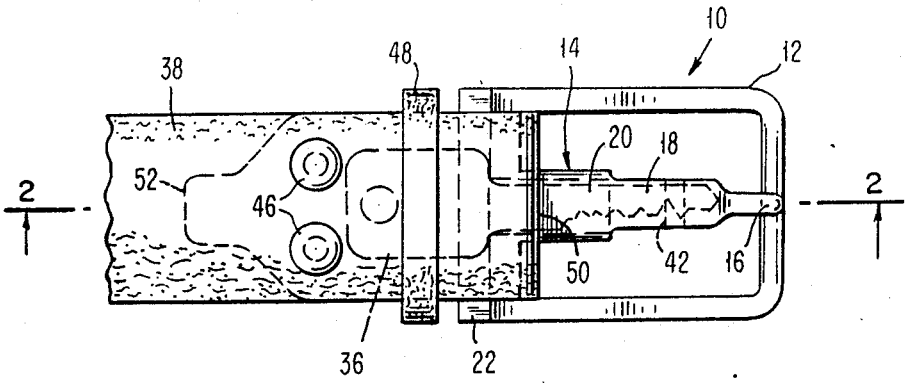
FIG. 1 is a front view of the belt and buckle assembly of the present invention, with the hidden key shown in phantom behind the tongue and key retainer and the belt.
Figure 2:
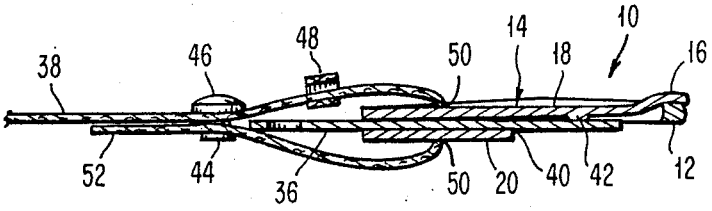
FIG. 2 is a cross-sectional view taken along lines 2—2 of FIG. 1.
Figure 3:
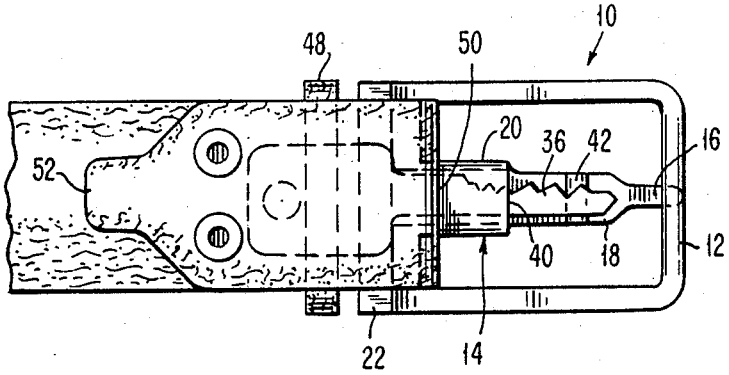
FIG. 3 is a back view of the belt and buckle assembly showing the tip portion of the key extending out of the key body retainer portion.
Figure 5:
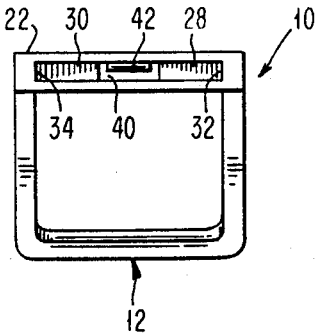
FIG. 5 is a back view of the tongue and key retainer and the buckle taken along lines 5—5 of FIG. 4.
Figure 6:
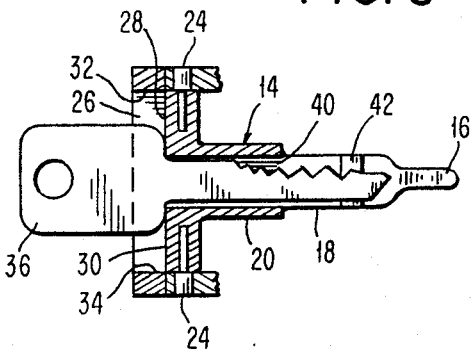
FIG. 6 is a cross-sectional view looking up along lines 6—6 of FIG. 4 taken along a longitudinal plane.

Referring generally to the Figures, there is shown a belt buckle assembly 10 comprising a U-shaped buckle member 12 comprising two leg portions, or legs, interconnected by a base portion, and a tongue and key retainer 14 having a tongue tip 16, a tongue body 18 with an elongated shape in the longitudinal tongue direction, and a key body retainer 20. The length of the belt tongue is essentially formed of the key body retainer 20, the tongue body 18 and the tongue tip 16 which, in this embodiment, are formed of a rigid metal body which can be formed by a die cast or injection mold process. The tongue and key retainer 14 also includes a key head retainer portion 22 connected to the end of the key body retainer. Key head retainer portion 22 is pivotally connected to the leg ends of the U-shaped buckle 12 by means of pivot pins 24 shown in greater detail in FIG. 6. The key head retainer portion 22 has an enlarged slot shaped opening 26 formed through its open end by shoulder wall portions including side walls 32 and 34 and upper and lower end walls 28 and 30 which form a shoulder stop for the head of a typical key 36. The back view of the retainer shown in FIG. 5 together with the cross-sectional view of FIG. 6 depicts the configuration of the key head retainer portion 22, the slot opening 26, and an elongated opening 40 or sleeve formed by the key body retainer 20 through which the body of key 36 extends. As can be seen in FIGS. 3, 5 and 6, the elongated opening 40 in key body retainer 20, and the key head opening 26 formed in the key head retainer portion 22, can be designed with a size that will accommodate several different sizes of keys therein since the shoulders 28 and 30 will prevent the key from advancing up to the tongue tip 16 as the head of key 36 will abut the shoulders 28 and 30.

Figure 4:
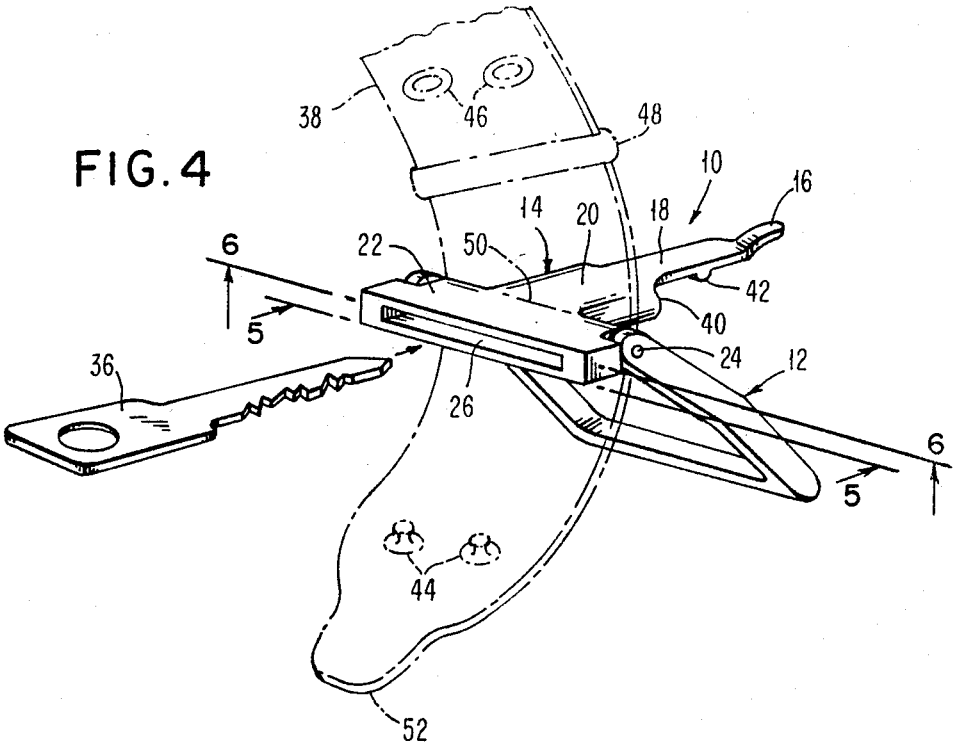
FIG. 4 is a prospective view of the belt, buckle and tongue and key retainer, and the key as they are being assembled.

Referring to FIGS. 1–4, the belt buckle assembly is assembled with a typical leather belt 38 having an opening 50 therein which is of the size and shape for receiving the tongue tip 16, the tongue body 18 and the key body retainer 20 therethrough. As shown in FIG. 4, the belt 38 covers the key head retainer portion 22 and a pair of interlocking snap buttons 44 and 46 are fastened to thereby secure the buckle assembly 10 with a key 36. The key 36 is prevented from moving substantially out of its retainer position within the openings 26 formed in head retainer portion 22 and the opening 40 formed in body retainer 20 by means of the snap buttons 46–44 against which the top end of key 36 will abut. The end of belt 38 has a pig tail 52 to facilitate grasping the belt end to undo the snap buttons 44–46 for removing the key. Also, a loop 48 is provided on the belt near the key head retainer portion 22 of the buckle assembly for holding the belt in.

A cam 42 is soldered or stamped onto the underside of the tongue body 18 at a position spaced apart from the tongue tip 16 so that the end portion of the key passes and rests against such cam 42. The action of the cam 42 pressing against the tip of key 36 will provide spring tension or pressure between the key and tongue to further stabilize and maintain the key in position in the tongue and key retainer 14.

In this fashion a belt buckle is provided having means for retaining different sizes and shapes of keys in a simple manner, without requiring large buckle plates, screws or other complex means for securing the key either to or within a buckle assembly.

While the invention has been described above with respect to its preferred embodiment, it should be understood that other forms and embodiments may be made without departing from the spirit and scope of the invention.

What is claimed is:

1. A belt buckle adapted for retaining keys of different sizes, each key having a head and a body portion, comprising:

a U-shaped buckle including a pair of leg portions interconnected by a base portion;

a combination tongue and key retainer including an elongated tongue body portion extending longitudinally and terminating at one end in a tongue tip adapted to contact said base portion of said U-shaped buckle, the other end of said tongue body forming a key retainer portion comprising an elongated hollow housing having two opposite ends which are open to form a sleeve through which said body portion of a key may extend in the direction of said tongue tip, said elongated hollow housing including shoulder wall portions at a first of said open ends of said hollow housing adapted for receiving a key therein, said second of said open ends of said hollow housing facing said tongue tip, said shoulder wall portions being adapted to abut with the head of said key for positioning said key within said hollow housing and preventing said key body portion from extending to said tongue tip; and means for pivotally connecting said tongue and key retainer to the end of each leg portion of said U-shaped buckle;

said tongue and key retainer being adapted to being attached to a belt of the type which can be fastened around said tongue and key retainer and retain said key therein.

2. A belt buckle as recited in claim 1, wherein said shoulder wall portions at said first open end of said hollow housing form a wide slot opening adapted for receiving the head of said key therein.

3. A belt buckle as recited in claim 2, wherein said shoulder wall portions extend substantially across the width of said belt buckle between said leg portions thereof.

4. A belt buckle as recited in claim 1, wherein said elongated hollow housing of said key retainer portions is formed integral with said elongated tongue body portion and together provide a narrow, elongated tongue adapted to hide said key from view.

5. A belt buckle as recited in claim 1, wherein said key retainer portion further comprises a key head retainer portion formed at said first open end of said hollow housing and forming a relatively wide slot shaped opening in line with said first open end and said second open end in said elongated hollow housing, said slot shaped opening being adapted to receive at least a portion of the head of a key therein.

6. A belt buckle as recited in claim 1, further comprising a raised cam portion protruding from the elongated tongue body portion near said tongue tip at the underside thereof and adapted for contacting said key near its tip to thereby provide pressure from said tongue body portion against said key to further maintain said key in the hollow housing of said key retainer.

7. A belt buckle as recited in claim 1, wherein said elongated tongue body portion and said elongated hollow housing of said key retainer portion are formed as a one body constituting said combination tongue and key retainer which extends longitudinally to said tongue tip.

8. A belt buckle and belt combination adapted for retaining keys of different sizes, each key having a head and a body portion, comprising:

a U-shaped buckle including a pair of leg portions interconnected by a base portion;

a combination tongue and key retainer including an elongated tongue body portion extending longitudinally and terminating at one end in a tongue tip adapted to contact said base portion of said U-shaped buckle, the other end of said tongue body forming a key retainer portion comprising an elongated hollow housing having an open end adapted to receive said body portion of a key therethrough with the body portion of said key extending in the direction of said tongue tip, said elongated hollow housing including shoulder wall portions at said key receiving open end being adapted to abut with the head of said key for positioning the key within said hollow housing and preventing said key body portion from extending to said tongue tip;

means for pivotally connecting said tongue and key retainer to the end of each leg portion of said U-shaped buckle whereby said tongue body portion can pivot relative to said U-shaped buckle; and a belt having one end provided with an opening near said end of said belt adapted to receive therethrough said elongated tongue body portion and said elongated hollow housing to permit attachment of said belt to said tongue and key retainer and said belt buckle, and fastening means near said end of said belt for securing the end of said belt to said belt and thereby securing said tongue and key retainer to said belt, said fastening means being releaseable to permit said key to be inserted and removed from said key retainer portion.

9. A belt buckle and belt combination as recited in claim 8, wherein said fastening means is positioned near the end of said belt at a predetermined distance from said tongue and key retainer and adapted so that a key will be prevented from moving out of said elongated hollow housing of said key retainer.

10. A belt buckle and belt combination as recited in claim 9, wherein said fastening means comprises snap buttons which interlock and snap open, thereby being adapted for storing and removing a key from said key retainer, said snap buttons being positioned on said belt such that said snap buttons, when interlocked, provide a means to prevent a key from moving substantially out of said elongated hollow housing of said key retainer.

11. A belt buckle and belt combination as recited in claim 8, further comprising a pig tail located at said end of said belt for grasping said belt and releasing said fastening means of said belt.

12. A belt buckle and belt combination as recited in claim 8, wherein said shoulder wall portions at said key receiving open end of said hollow housing form a wide slot opening adapted for receiving the head of said key therein.

13. A belt buckle and belt combination as recited in claim 8, wherein said elongated hollow housing forms a narrow, elongated shape with said key receiving open end at one side and a key body portion receiving open end at the opposite end of said hollow housing through which said body portion of said key may extend in the direction of said tongue tip.

14. A belt buckle and belt combination as recited in claim 8, wherein said elongated hollow housing of said key retainer portion is formed integral with said elongated tongue body portion and provide a narrow, elongated tongue adapted to hide said key from view.

15. A belt buckle as recited in claim 8, wherein said key retainer portion further comprises a key head retainer portion formed at the key receiving open end of said hollow housing by said shoulder wall portions of said elongated hollow housing, thereby forming a relatively wide slot shaped opening in line with said open end in said elongated hollow housing, said slot shaped opening being adapted to receive at least a portion of the head of a key therein.

16. A belt buckle as recited in claim 8, further comprising a raised cam portion protruding from the elongated tongue body portion near said tongue tip at the underside thereof and adapted for contacting said key near its tip to thereby provide pressure from said tongue body portion against said key to further maintain said key in the hollow housing of said key retainer.

17. A belt buckle as recited in claim 8, wherein said elongated tongue body portion and said elongated hollow housing of said key retainer portion are formed as one body constituting said combination tongue and key retainer which extends longitudinally to said tongue tip.

* * * * *